United States Patent [19]

Lazzarotti

[11] Patent Number: 5,050,743

[45] Date of Patent: Sep. 24, 1991

[54] COMBINED SACK AND TRAY SYSTEM FOR MAIL COLLECTION

[75] Inventor: Sebastian J. Lazzarotti, Broomall, Pa.

[73] Assignee: Unisys Corporation, Blue Bell, Pa.

[21] Appl. No.: 569,218

[22] Filed: Aug. 17, 1990

Related U.S. Application Data

[63] Continuation of Ser. No. 414,677, Sep. 29, 1989, abandoned.

[51] Int. Cl.[5] ..... B42F 17/00

[52] U.S. Cl. ..... 211/12; 248/100

[58] Field of Search ..... 211/10, 12; 248/97, 248/98, 99, 100, 101

[56] References Cited

U.S. PATENT DOCUMENTS

| | | | |
|---|---|---|---|
| 380,543 | 4/1888 | Allen | 248/100 |
| 399,486 | 3/1889 | Bradshaw et al. | 248/100 |
| 447,686 | 3/1891 | Holladay | 248/100 |
| 641,055 | 1/1900 | Thompson | 248/100 X |
| 688,238 | 12/1901 | Davis | 248/100 |
| 691,120 | 1/1902 | Elliott | 248/100 X |
| 862,243 | 8/1907 | Field | 211/12 |
| 868,504 | 10/1907 | Taylor | 248/100 |
| 999,406 | 8/1911 | Skelton | 248/100 |
| 1,018,637 | 2/1912 | Shults | 211/12 |
| 1,080,685 | 12/1913 | Fuller | 248/100 |
| 1,456,175 | 5/1923 | Borlase | 248/99 |
| 1,598,533 | 8/1926 | Larsen | 248/100 |
| 1,679,450 | 8/1928 | Thompson | 248/100 |
| 1,699,188 | 1/1929 | Granberg | 248/100 |
| 1,700,717 | 1/1929 | Piombo | 248/100 |
| 1,796,288 | 3/1931 | Hester | 248/100 |
| 2,468,637 | 4/1949 | Potter | 248/100 |
| 2,471,218 | 5/1949 | Jones | 248/100 |
| 2,492,448 | 12/1949 | Siegman et al. | 248/100 |
| 2,525,113 | 10/1950 | Berg | 248/100 |

*Primary Examiner*—David L. Talbott
*Assistant Examiner*—Daniel Hulseberg
*Attorney, Agent, or Firm*—Whitham & Marhoefer

[57] ABSTRACT

A dual sack rack frame (10) allows mail sacks (12) and (14) of different sizes or, alternatively, tray receptacles (100) and (110) to be used as output for the small parcels and bundles sorting system used by the United States Post Office. The mail sacks (12) and (14) are connected to rear, pivotable, spring biased retention hooks 46 and front, stationary hooks (50) or (52), respectively. The tray receptacles (100) and (110) are positioned on tray supports (36) which are pivoted downward when mail sack collection is no longer desired. The dual sack rack frame (10) is easily exchangeable with other collection receptacles by simply pivoting the chute support brackets (32) to a non-supportive position and detaching the plunger pin (22) which connects it to the stabilizing frame.

9 Claims, 2 Drawing Sheets

COMBINED SACK AND TRAY SYSTEM FOR MAIL COLLECTION

DESCRIPTION

This application is a continuation of U.S. patent application Ser. No. 07/414,677 filed Sep. 29, 1989 now abandoned.

BACKGROUND OF THE INVENTION

1. Field of the Invention

The present invention is generally related to mail sorting systems and, more particularly, to an apparatus which may either retain mail sacks of varying sizes in their open position or hold mail trays such that parcels and bundles can be collected in the mail sacks or trays.

2. Description of the Prior Art

The small parcel and bundle sorting system presently used by the United States Postal Service employs only plastic trays or large wire containers to collect sorted mail. The sorting system would be more versatile if mail sacks could be used as an alternate receptacle for receiving sorted mail pieces. Even greater utility would be realized from a system which readily converted between a sack or tray output system.

In order to use mail sacks in conjunction with the small parcel and bundle sorting system, the mail sacks would need to be held open and upright such that mail could be dropped into the sack from the sorting chute.

Racks for holding a sack open to receive packages or parcels are known in the art. Most sack racks utilize the metal eyelets which are present about the top periphery of mail sacks. The metal eyelets are typically hooked to the sack rack such that the top of the sack is held open. Hooking the metal eyelets of a mail sack to a rack system is not a convenient method for use in the small parcel and bundle sorting system environment. The volume of mail handled at mail processing centers is very large and the collecting receptacles must be changed frequently as they are filled with mail. A sweep attendant could experience difficulty in unhooking the eyelets of a filled mail sack and then hooking the eyelets of an empty mail sack at rates that accommodate the processing rate of the of the sorting machine.

The Post Office uses mail sacks of varying sizes. For example, the air mail parcel post sack used by the Post Office has a sack opening of fifteen inches by fifteen inches, whereas the air mail and first class mail sacks have sack openings of fifteen inches by ten and one quarter inches. Sack racks which use stationary hooks to hold a mail sack open by its metal eyelets are not versatile enough to handle the varying sizes of mail sacks used by the Post Office. A smaller mail sack, such as a first class mail sack, could not be hooked to a rack sized to handle a larger mail sack, such as an air mail parcel post sack, because the smaller sack could not be opened wide enough for the hooks to fasten to the metal eyelets of the sack. Likewise, a larger mail sack could not be hooked to a rack sized to handle a smaller mail sack because the larger mail sack would tend to fold inwardly and block off the sack opening from receiving the sorted mail.

A need exists for a sack rack which can be used with the small parcel and bundle sorting system. The sack rack must be designed to allow a sweep attendant to quickly change mail sacks and to accommodate mail sacks of varying sizes. In addition, the sack rack should be quickly convertible between sack sorting and tray sorting receptacles.

SUMMARY OF THE INVENTION

It is therefore an object of this invention to provide a sack rack which allows for grasping the sack at any four points along its open edge rather than requiring hooking the metal eyelets of the mail sack.

It is another object of this invention to provide a sack rack that can readily accommodate mail sacks of varying sizes.

It is yet another object of this invention to provide a rack which can be readily interchanged with other forms of receptacles presently used by the small parcel and bundle sorting machine.

It is still another object of this invention to provide a rack with integrated sack retaining and tray support mechanisms to allow for quick conversion between the two receptacles.

According to the invention, a rack has been designed to hold either a mail sack or tray collection receptacle. The rack is positioned beneath a mail chute such that the small parcels and bundles sorting system can direct mail into the mail sack or tray receptacle. The sack retaining mechanism and the tray support are affixed to the rack at an inclined angle to maximize the opening of the mail sack or tray relative to the mail chute. The sack retaining mechanism is positioned at the top of the rack and allows the bottom of an attached mail sack to rest on the floor. The tray support is pivotally affixed to the rack towards its rear, bottom portion. When tray receptacles are required, the tray support is pivoted downward and rests on support brackets mounted on the forward portion of the rack. The tray support is positioned on the rack at a point which allows trays to be clear from the sack retaining mechanism hooks. Connecting arms connect the rack to the stabilizer frame of the small parcels and bundles sorting machine. A chute support bracket is affixed to the top of the rack to provide support for the mail chute extending from the sorting machine.

The sack retaining mechanism comprises two pairs of fixed, front retention hooks and one pair of spring biased, pivotable, rear retention hooks. A mail sack is connected to the rack using the rear retention hooks and one of the two front pairs of retention hooks wherein the two front pairs are spaced to accommodate two different ranges of sack opening sizes. Preferably, the pair of front retention hooks closest to the rear retention hooks will be used for holding mail sacks that have approximately a ten inch by fifteen inch opening and the pair of front retention hooks furthest from the rear retention hooks will be used for holding mail sacks that have approximately a fifteen inch by fifteen inch opening. The spring member connected to the rear retention hooks and the pivotability of the rear retention hooks allows a modest range of sack opening sizes to be accommodated with either pair of front retention hooks. An empty mail sack is attached by hooking the rim of the sack onto the rear hooks and pulling the sack forward until the front rim of the sack can be slipped onto the appropriate front pair of hooks. The hooks can engage any point on the top, inside rim of the sack and do not need to engage the metal eyelets positioned about the top periphery of the sack opening. A filled mail sack is removed by pulling the front rim of the sack forward to allow it to drop free which, in turn, allows the rear portion of the sack rim to drop freely from the rear retention hooks.

The need to change a mail sack during sorting can be determined either by visual sweep attendant observation or by audio-visual sweep alarms which are triggered through internal system monitoring of processing functions. A button switch, positioned elsewhere at the output station and electrically connected to the small parcels and bundles sorting machine, controls a bypass feature of the sorting machine. A sweep attendant depresses the button switch when mail sacks are to be changed. The button switch for the particular mail sack to be changed is depressed before removing the mail sack to prevent the flow of mail to that mail sack and then depressed again when an empty mail sack has been connected to the sack retaining mechanism to re-establish the flow of mail to that destination.

The tray support is pivoted from its rear, storage position to its inclined, mail receiving position when tray receptacles are desired. The trays are simply placed on the tray support for collection of mail pieces. As described above in connection with changing mail sacks, the button switch which controls the bypass function is depressed when trays are to be changed.

Preferably, the rack is designed to handle two mail output chutes. Therefore, two mail sacks of different sizes can be connected on the same rack or a mail sack and a tray collection receptacle can be present on the rack simultaneously for receiving mail sent to adjacent mail chutes. The dual sack rack can easily be disconnected and stored when using other types of receptacles is desired.

BRIEF DESCRIPTION OF THE DRAWING

The foregoing and other objects, aspects and advantages will be better understood from the following detailed description of the preferred embodiment of the invention with reference to the drawings, in which.

DETAILED DESCRIPTION OF THE PREFERRED EMBODIMENT OF THE INVENTION

Figure 1:
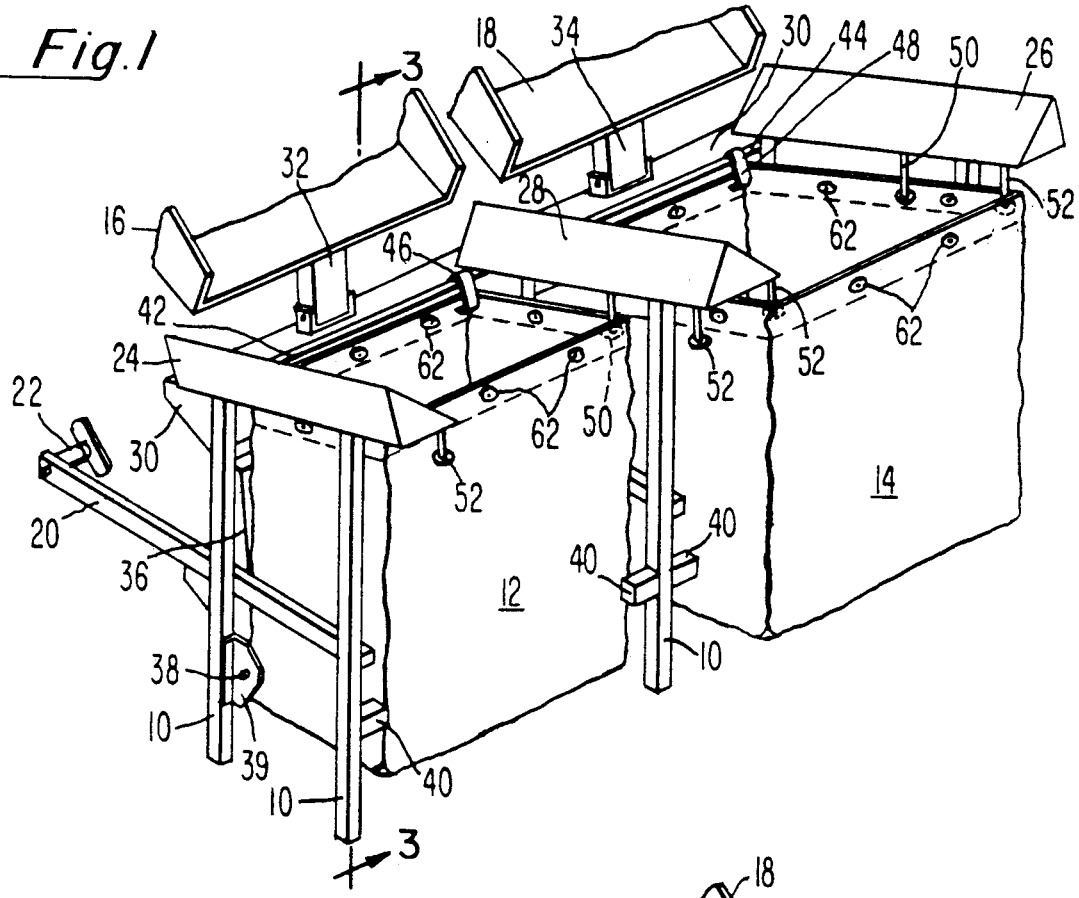
FIG. 1 is an isometric view of a dual sack rack positioned under a pair of adjacent mail chutes which has two mail sacks of different sizes affixed thereto.

Referring now to the drawings and, more particularly to FIG. 1, there is shown a dual sack rack frame 10 which is able to hold two mail sacks 12 and 14 underneath adjacent mail chutes 16 and 18 so that they may receive sorted parcels of mail. The dual sack rack frame 10 is connected to the stabilizer frame (not shown) of the small parcel and bundle sorting machine by a connecting bar 20 and plunger pin 22. The sack retaining mechanism is positioned at the top of the dual sack rack frame 10 and is comprised of pivot bars 42 and 44 on which are mounted pairs of spring biased, rear retention hooks 46 and 48, respectively, and cover elements, 24, 26, and 28 under which two pairs of fixed, front retention hooks 50 and 52, are mounted for securing each mail sack 12 and 14. Button switches (not shown) are positioned elsewhere on the output station and are electrically connected to the small parcel and bundle sorting machine for causing the sorting machine to either bypass or send mail to mail sacks 12 and 14, respectively. The sack retaining mechanism is preferably positioned at a height which will allow the base of mail sacks 12 and 14 to rest on the floor. The top rear shelf 30 of the dual sack rack frame 10 includes a pair of pivotal chute supporting brackets 32 and 34 for supporting mail chutes 16 and 18, respectively. Tray supports 36 are positioned behind the mail sacks 12 and 14 and are connected to the dual sack rack frame 10 by pivot pins 38. When the mail sacks 12 or 14 are removed, the tray supports 36 are pivoted downward and rest on stops 40 affixed to the front portion of frame 10.

Figure 3:
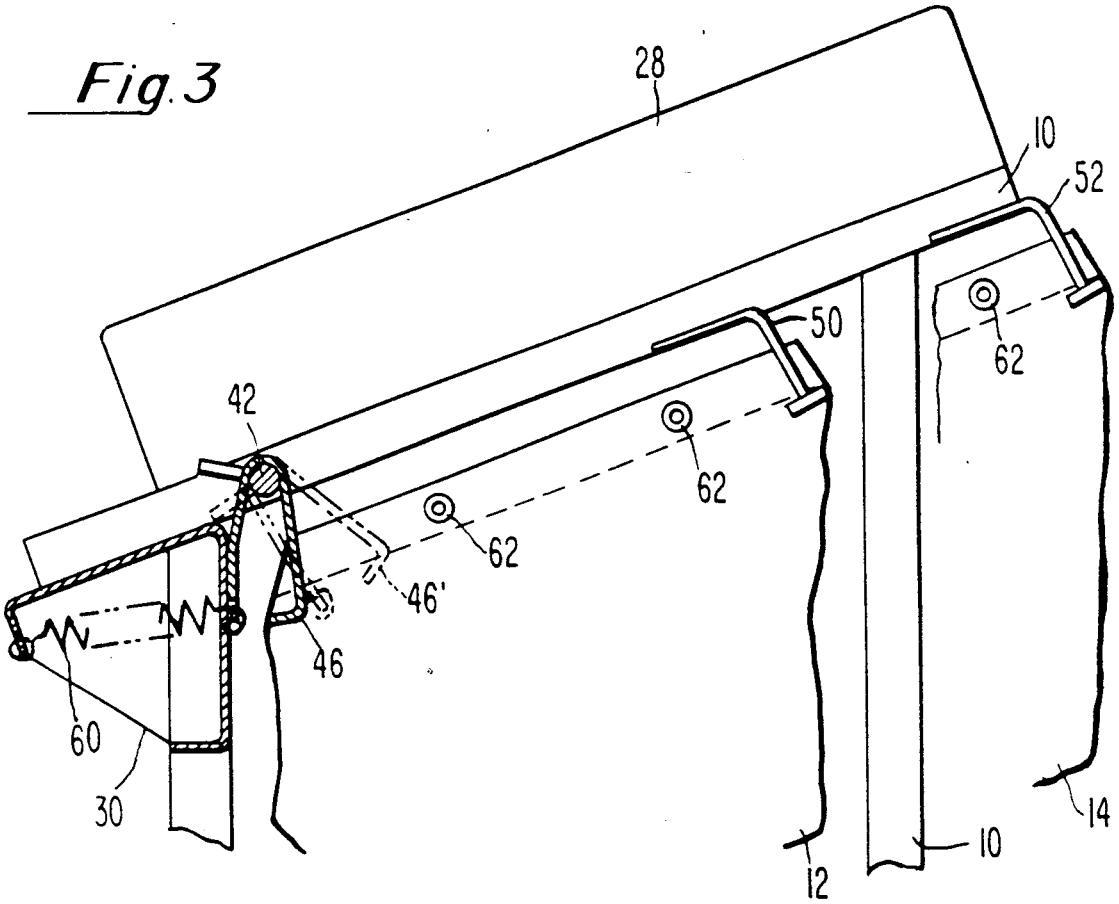
FIG. 3 is an enlarged cross-sectional side view of the sack retention mechanism taken along line 3—3 in FIG. 1.

FIG. 3 shows a cross-sectional side view of the dual sack rack shown in FIG. 1 where the smaller mail sack 12 is connected to the rear retention hook 46 and first front retention hook 50. Larger mail sack 14 is partially shown and could be connected to the rear retention hook 46 and the second front retention hook 52. The front retention hooks 50 and 52 are fixed to the dual sack rack frame 10 while the rear retention hook 46 is positioned on pivot bar 42 and is permitted to pivot relative to the frame 10 as shown by the dashed line drawing of the rear retention hook 46'. A spring 60 is connected to the rear retention hook 46 and provides a force sufficient for retention of the sack 12 or 14 in its open position to ensure proper entry of mail being sorted. The dual sack rack frame 10 is inclined to maximize the opening of the mail sack 12 or 14 relative to the mail chute 16.

Referring to both FIGS. 1 and 3, to mount a mail sack 12 or 14 on the rack 10, the sweep attendant must first hook the rim of the sack 12 or 14 onto the rear retention hooks 46. Then, the sack 12 or 14 is pulled forward until the forward rim of the sack 12 or 14 can be slipped onto the appropriate front pair of hooks 50 or 52, respectively. The rear retention hooks 46 are permitted to pivot forward as the mail sack 12 or 14 is pulled forward and the spring 60 biases the rear retention hooks toward the rear of the frame 10 after the mail sack 12 or 14 is attached. An important advantage of this hooking arrangement is that the hooks 46, 50 or 52 need only contact an inside portion of the sack rim, and the metal eyelets 62, present about the periphery of the sack rim, are not required for connecting the sack 12 or 14 to the frame 10. To release the mail sack 12 or 14 when replacement is required the reverse procedure is followed, i.e., the front rim of the sack 12 or 14 is pulled forward to a point where it drops free of the fixed, front hooks 50 or 52, respectively, thereby permitting the rear rim of the sack 12 or 14 to drop free of the spring biased rear retention hooks 46.

For each exchange of an empty mail sack for a full mail sack, the sweep attendant must depress a bypass button switch (not shown), elsewhere located on the output station and corresponding to that sack destination, before making the exchange. The bypass button switches are electrically connected to the small parcels and bundles sorting machine via a plug connection (not shown). A first depression of a button switch causes the sorting machine to stop sending mail pieces to mail chute 16 or 18, respectively. The mail sacks 12 or 14 are exchanged after the first depression of their respective button switch. A second depression of the button switch causes the sorting machine to resume sending mail pieces to that destination. The need to change a mail sack 12 or 14 during sorting can be determined either by visual sweep attendant observation or by audio-visual sweep alarms which are triggered through internal system monitoring of processing functions.

Figure 2:
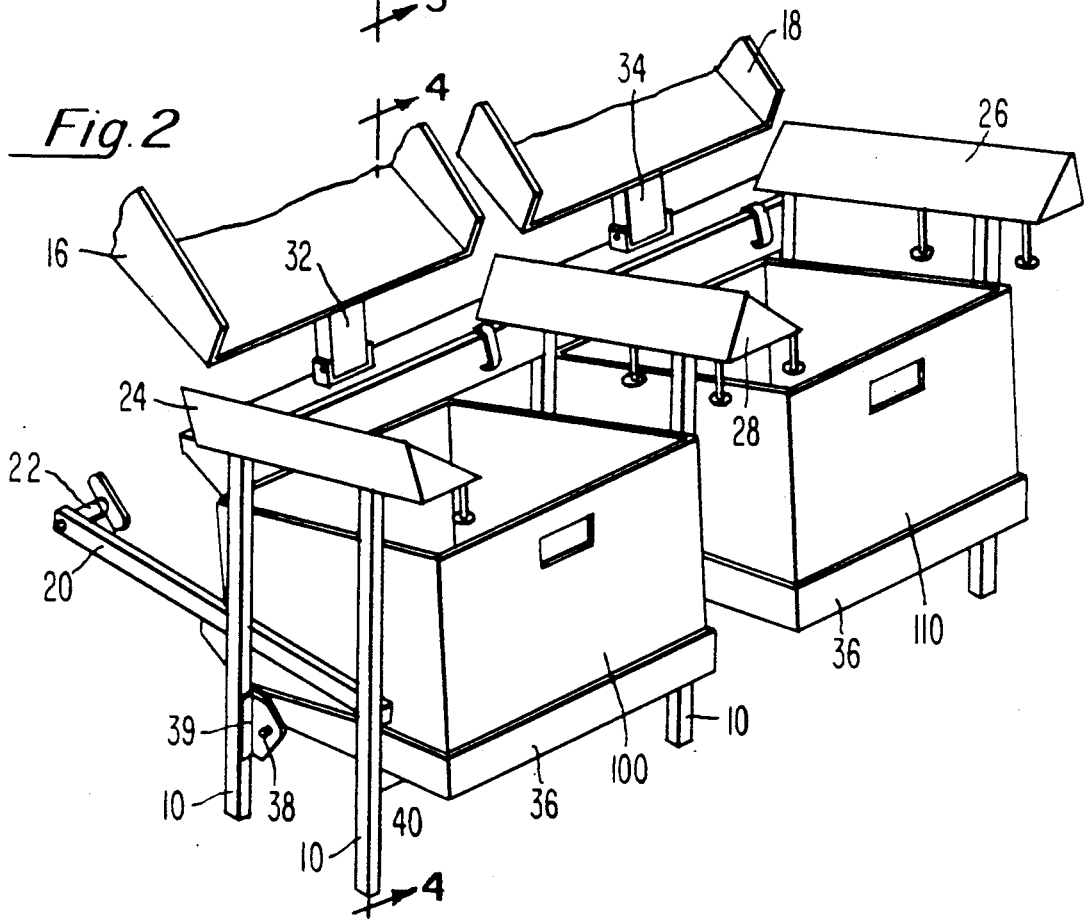
FIG. 2 is an isometric view of the dual sack rack shown in FIG. 1 with the tray supports pivoted to a tray holding position and having tray receptacles positioned thereon.
Figure 4:
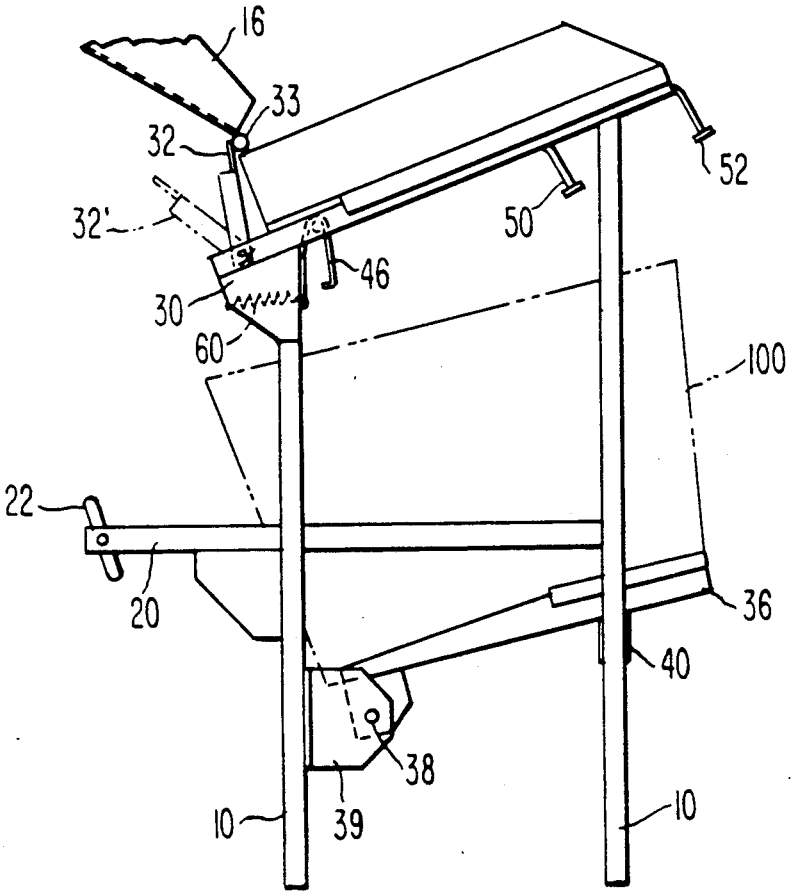
FIG. 4 is a cross-sectional side view of the dual sack rack taken along line 4—4 of FIG. 2 showing the tray support pivoted to the tray holding position and having a tray positioned thereon and showing the mail chute support pivotally affixed to the dual sack rack frame.

Referring to FIGS. 1, 2, and 4, tray supports 36 are stored behind the mail sacks 12 and 14 in an upright position when collection of mail pieces in the sacks 12 and 14 is desired. When collection of mail pieces in the tray receptacles 100 and 110 is desired, the mail sacks 12 and 14 are removed as described above and the tray supports 36 are pivoted downward onto stops 40. Pivoting occurs about pivot pins 38 which are secured to the tray supports 36 and pivot within bracket 39 which is affixed to the dual sack rack frame 10. Then, the tray receptacles 100 and 110 are simply placed on the tray supports. Button bypass switches (not shown), elsewhere located at the output station and electrically connected to the sorting system, are operated as described above for disabling and enabling the flow of mail pieces when exchanging full tray receptacles for empty tray receptacles.

FIG. 4 shows that the tray supports 36 are held at a slight incline to maximize the opening of the tray receptacle 100 relative to the mail chute 16. The tray support 36 is positioned far enough below sack retention hooks 46, 50 and 52 such that minimal interference will occur when placing a tray receptacle 100 or 110 on the tray support 36. The chute supporting bracket 32 positioned on the top rear bar 30 of the dual sack rack frame 10 is pivotable from its non-supportive position 32' to a supportive position where it is secured in a captive receiver nest 33 positioned on the mail chute 16. The chute supporting bracket 32 effectively holds the mail chute 16 in a discharge position for dispensing mail pieces into the tray receptacle of mail sack.

An advantage of the dual sack rack 10 is its versatility in the types and sizes of receptacles it can accommodate. FIG. 1 shows mail sacks 12 and 14 having different sized openings on the same dual sack rack frame 10. FIG. 2 shows tray receptacles 100 and 110 positioned on tray supports 36 which have been pivoted into position on the dual sack rack frame 10. Having the tray supports 36 pivotally mounted on the dual sack rack frame 10 allows for extremely quick switching between output containers. It is possible for the dual sack rack to have adjacent mail chutes 16 and 18 dispensing to a mail sack and a tray receptacle which are held on the same dual sack rack frame 10.

The dual sack rack frame 10 has been designed to be easily disengageable from the small parcels and bundles sorting machine to permit the use of large output containers used by the machine. The sweep attendant only needs to pivot the chute supporting bracket 32 to its non-supportive position 32' to allow the mail chutes 16 and 18 to drop to a hanging position and disconnect the plunger pin 22 to release the connecting arm 20 from the sorting machine stabilizing frame. The sweep attendant can then remove the dual sack frame 10 for storage while another form of output receptacle is used.

While the invention has been described in terms of its preferred embodiment where a sack rack is capable of handling the output from adjacent mail chutes and the sack retaining mechanism is comprised of rear spring biased retention hooks and fixed front retention hooks, those skilled in the art will recognize that the sack rack can be made to handle the output of one or a plurality of mail chutes and that different hooking arrangements can be utilized within the spirit and scope of the appended claims.

Having thus described my invention, what I intend to secure by letters patent is the following:

1. An apparatus for supporting a mail sack comprising:

a frame having height, width and depth dimensions;

a pair of downwardly projecting, pivotal, spring-biased sack support members connected to said frame at a first height above a base of said frame, said pair of downwardly projecting, pivotal, spring biased sack support members being separated by a first width, said pair of downwardly projecting, pivotal, spring biased sack support members being capable of grasping any point on an inside peripheral rim of a sack without puncturing said sack;

a first pair of downwardly projecting stationary sack support members connected to said frame at a second height above said base of said frame and separated by a second width substantially equal to said first width between said pair of downwardly projecting, pivotal, spring biased sack support members, said first pair of downwardly projecting stationary sack support members positioned at a first depth forward from said pair of downwardly projecting, pivotal, spring biased sack support members,, said first pair of downwardly projecting stationary sack support members being capable of grasping any point on an inside peripheral rim of a first sized sack without puncturing said first sized sack, said first pair of downwardly projecting stationary sack support members and said pair of downwardly projecting, pivotal, spring biased sack support members serving as four support corners for said first sized sack; and a second pair of downwardly projecting stationary sack support members connected to said frame at a third height above said base of said frame and separated by a third width substantially equal to said first width between said pair of downwardly projecting, pivotal, spring biased sack support members, said second pair of downwardly projecting stationary sack support members positioned at a second depth forward from said pair of downwardly projecting, pivotal, spring biased sack support members, said second depth forward from said pair of downwardly projecting, pivotal, spring biased sack support members being greater than said first depth forward, said second pair of downwardly projecting stationary sack support members being capable of grasping any point on an inside peripheral rim of a second sized sack without puncturing said second sized sack, said second sized sack having a larger inside peripheral rim than said first sized sack, said second pair of downwardly projecting stationary sack support members and said pair of downwardly projecting, pivotal, spring biased sack support members serving as four support corners for said second sized sack.

2. An apparatus as recited in claim 1 wherein said second height above said base for said first pair of downwardly projecting stationary sack support members and said third height above said base for said second pair of downwardly projecting stationary sack support members are greater than said first height above said base for said pair of downwardly projecting, pivotal, spring-biased sack support members on said frame.

3. An apparatus as recited in claim 1 further comprising a tray support pivotally attached to said frame at a first point which is of equivalent depth to and below said pair of downwardly projecting, pivotal, spring-biased sack support members and a bracket attached to said frame at a second point which is of a third depth forward of said first point and below said first and second pairs of downwardly projecting stationary sack support members, said bracket being capable of supporting a free end of said tray support in a tray holding position.

4. An apparatus as recited in claim 1 further comprising a chute supporting bracket, pivotally connected to said frame at a position between said first width between said downwardly projecting, pivotal, spring-biased sack support members, for holding a chute in a discharge position.

5. An apparatus for supporting a pair of mail sacks comprising:

a frame having height, width and depth dimensions;

two pairs of downwardly projecting, pivotal, spring-biased sack support members connected to said frame at a first height above a base of said frame, each of said pairs of downwardly projecting, pivotal, spring biased sack support members being separated by a first width, each of said pairs of downwardly projecting, pivotal, spring biased sack support members being capable of grasping any point on an inside peripheral rim of a sack without puncturing said sack;

two first pairs of downwardly projecting sack support members connected to said frame at a second height above said base of said frame and each of said first pairs of downwardly projecting sack support members being separated by a second width substantially equal to said first width between said two pairs of downwardly projecting, pivotal, spring biased sack support members, each of said first pairs of downwardly projecting stationary sack support members positioned at a first depth forward from said pairs of downwardly projecting, pivotal, spring biased sack support members, each of said first pairs of downwardly projecting stationary sack support members being capable of grasping any point on an inside peripheral rim of a first sized sack without puncturing said first sized sack, each of said first pairs of downwardly projecting stationary sack support members cooperating with one of said pairs of downwardly projecting, pivotal, spring biased sack support members to serve as four support corners for said first sized sack; and two second pairs of downwardly projecting stationary sack support members connected to said frame at a third height above said base of said frame and each of said second pairs of downwardly projecting sack support members being separated by a third width substantially equal to said first width between said two pairs of downwardly projecting, pivotal, spring biased sack support members, each of said second pairs of downwardly projecting stationary sack support members positioned at a second depth forward from said pairs of downwardly projecting, pivotal, spring biased sack support members, said second depth forward from said pair of downwardly projecting, pivotal, spring biased sack support members being greater than said first depth forward, each of said second pairs of downwardly projecting stationary sack support members being capable of grasping any point on an inside peripheral rim of a second sized sack without puncturing said second sized sack, each of said second pairs of downwardly projecting stationary sack support members cooperating with one of said pairs of downwardly projecting, pivotal, spring biased sack support members to serve as four support corners for said second sized sack, said apparatus capable of supporting alternatively one of said first sized sacks, two of said first sized sacks, one of said second sized sacks, two of said second sized sacks, or a first sized sack and a second sized sack.

6. An apparatus as recited in claim 5 wherein said two pairs of downwardly projecting, pivotal, spring biased sack support members, said two first pairs of downwardly projecting stationary sack support members, and said two second pairs of downwardly projecting stationary sack support members are arranged such that a first sack holding group comprised of a first pair of downwardly projecting, pivotal, spring biased sack support members, a first first pair of downwardly projecting stationary sack support members, and a first second pair of downwardly projecting stationary sack support members is positioned adjacent a second sack holding group comprised of a second pair of downwardly projecting, pivotal, spring biased sack support members, a second first pair of downwardly projecting stationary sack support members, and a second second pair of downwardly projecting stationary sack support members.

7. An apparatus as recited in claim 6 further comprising two chute supporting brackets, each of said chute supporting brackets pivotally connected to said frame to support two chutes in discharge positions so that mail pieces may be discharged into sacks connected to said first and second sack holding groups.

8. An apparatus as recited in claim 5 wherein said second height above said base for said two first pairs of downwardly projecting stationary sack support members and said third height above said base for said two second pairs of downwardly projecting stationary sack support members are greater than said first height above said base for said two pairs of downwardly projecting, pivotal, spring biased sack support members on said frame.

9. An apparatus as recited in claim 5 further comprising two tray supports, each of said tray supports being pivotally attached to said frame at first points which are of equivalent depth to and below said two pairs of downwardly projecting, pivotal, spring-biased sack support members and two brackets attached to said frame at second points which are of a third depth forward of said first points and below said two first and second pairs of downwardly projecting stationary sack support members, each of said brackets being capable of supporting a free end of one of said tray supports in a tray holding position, said apparatus further capable of alternatively supporting one of said first sized sacks and a tray, one of said second sized sacks and a tray, or two trays.

* * * * *